US008898946B1

(12) United States Patent
Johnson

(10) Patent No.: US 8,898,946 B1
(45) Date of Patent: Dec. 2, 2014

(54) MAGAZINE ADAPTER

(71) Applicant: David Arthur Johnson, Salem, OR (US)

(72) Inventor: David Arthur Johnson, Salem, OR (US)

( * ) Notice: Subject to any disclaimer, the term of this patent is extended or adjusted under 35 U.S.C. 154(b) by 91 days.

(21) Appl. No.: 13/873,954

(22) Filed: Apr. 30, 2013

Related U.S. Application Data

(60) Provisional application No. 61/687,626, filed on Apr. 30, 2012.

(51) Int. Cl.
*F41A 9/71* (2006.01)
*F41A 9/65* (2006.01)

(52) U.S. Cl.
CPC .... *F41A 9/71* (2013.01); *F41A 9/65* (2013.01)
USPC ..... 42/49.02; 42/50

(58) Field of Classification Search
CPC ..... F41A 9/70; F41A 9/71
USPC ..... 42/49.01–49.5, 49.1, 17
See application file for complete search history.

(56) References Cited

U.S. PATENT DOCUMENTS 4,058,922 A * 11/1977 Elbe et al. ..... 42/16
4,069,608 A * 1/1978 Jurek ..... 42/49.02
4,079,535 A * 3/1978 Elbe et al. ..... 42/49.02
4,098,016 A * 7/1978 Foote ..... 42/16
4,139,958 A 2/1979 Foote
4,619,062 A * 10/1986 Johnson ..... 42/70.11
4,709,496 A * 12/1987 Johnson ..... 42/70.11
5,416,998 A * 5/1995 Martel ..... 42/6
5,555,661 A 9/1996 Yap
5,566,488 A 10/1996 Yap
6,070,352 A * 6/2000 Daigle ..... 42/49.02
6,470,614 B1 * 10/2002 Johnson ..... 42/17
7,444,775 B1 * 11/2008 Schuetz ..... 42/76.01
7,562,482 B1 * 7/2009 Johnson ..... 42/90
8,387,296 B2 3/2013 Overstreet et al.
8,572,875 B2 * 11/2013 Sisgold ..... 42/1.02
2011/0214326 A1 * 9/2011 Inskeep et al. ..... 42/49.02
2011/0247482 A1 10/2011 Overstreet et al.
2011/0247483 A1 10/2011 Overstreet et al.
2014/0223791 A1 * 8/2014 Ruby et al. ..... 42/49.01
2014/0250751 A1 * 9/2014 Foster ..... 42/6

OTHER PUBLICATIONS

Smith & Wesson website showing a magazine for a Smith & Wesson M&P15-22 rifle, http://www.smith-wesson.com/webapp/wcs/stores/servlet/Product4_750001_750051_766288_-1_758016_75.

Midway website showing a magazine for a Smith & Wesson M&P15-22 rifle, http://www.midwayusa.com/product/593377/smith-and-wesson-magazine-s-and-w-m-and-p-15-22-22-long-rifle-2.

* cited by examiner

*Primary Examiner* — Michael David
(74) *Attorney, Agent, or Firm* — William F. Lang, IV; Lang Patent Law LLC

(57) ABSTRACT

A magazine adapter includes a base that is structured to fit within the magazine well of a firearm, and to accept a magazine designed for smaller caliber ammunition than the original firearm. The adapter includes a bolt catch actuator slidably mounted therein. Magazines for which the adapter is intended include an upwardly extending rear projection of the follower, projecting from an opening in the rear of the magazine housing when the follower is in an upper portion of the magazine. When the upwardly extending projection pushes upward on the bolt catch actuator, the bolt catch is actuated, holding the firearms bolt in a rearward position. The magazine adapter thereby facilitates use of the original firearm controls with a caliber conversion unit, or with an upper receiver and barrel combination of a different caliber.

16 Claims, 7 Drawing Sheets

MAGAZINE ADAPTER

CROSS REFERENCE TO RELATED APPLICATION

This application claims the benefit of U.S. provisional patent application Ser. No. 61/687,626, filed Apr. 30, 2012, and entitled "Smith & Wesson .22 rimfire adapter block assembly."

TECHNICAL FIELD

The present invention relates to magazine adapters. More specifically, an adapter for utilizing a magazine for ammunition having a shorter overall length than the ammunition for which the firearm was originally designed is provided.

BACKGROUND INFORMATION

It is often desirable to shoot smaller caliber ammunition from a larger caliber firearm, thereby reducing the cost of the ammunition utilized, as well as possibly reducing felt recoil and/or noise during practice. In the case of a .22 caliber firearm, inexpensive rimfire ammunition may be utilized in firearms that were originally designed for centerfire ammunition by utilizing an appropriate conversion unit. Additionally, in the case of a rifle having separate upper receiver and lower receiver portions, for example, an AR-15 or M-16 type rifle, the upper receiver and barrel (hereinafter upper receiver assembly) can be separated from the lower receiver, and replaced with an upper receiver assembly of a different caliber. In either case, it is necessary to utilize a magazine designed for the smaller caliber ammunition within the magazine well that was designed for magazines holding larger caliber ammunition.

One adapter for use with a conversion assembly for utilizing .22 long rifle ammunition in an AR-15 rifle chambered for 5.56 mm. ammunition is disclosed in U.S. Pat. No. 8,387,296, issued to J. L. Overstreet et al. on Mar. 5, 2013. This adapter includes an actuator housing that fits at the top of the magazine well of a rifle, being secured between the upper receiver and lower receiver. The actuator housing defines a rectangular opening for receiving the top portion of a magazine, including the feed lips. A bolt catch actuator is slidably mounted in a rear portion of the actuator housing. The actuator includes a tab for engaging the rear portion of the follower of the magazine, and a rear portion for engaging the bolt catch on the rifle. This adapter relies on a magazine having a two-piece follower, with a main portion and an upper displaceable portion secured to the main portion. The upper displaceable portion is spring-biased rearward, so that upon the upper displaceable portion reaching the top of the magazine after the last cartridge is expended, the upper displaceable portion moves rearward under spring pressure to a position wherein it can engage the tab of the bolt catch actuator. By securing the base between the upper and lower receivers, which typically fit close together, there is some difficulty in securing the upper receiver to the lower receiver, as well as the potential for some stress on the forward screw and rear pin securing the two receiver portions together.

A similar adapter is disclosed in US 2011/0247483, filed by J. L. Overstreet et al. and published on Oct. 13, 2011. This adapter includes an actuator housing that fits at the top of the magazine well of a rifle, being secured between the upper receiver and lower receiver. The actuator housing defines a rectangular opening for receiving the top portion of a magazine, including the feed lips. A bolt catch actuator is slidably mounted in a rear portion of the actuator housing. The actuator includes a tab for engaging the rear portion of the follower of the magazine, and a rear portion for engaging the bolt catch on the rifle. As with U.S. Pat. No. 8,387,296, by securing the base between the upper and lower receivers, which typically fit close together, there is some difficulty in securing the upper receiver to the lower receiver, as well as the potential for some stress on the forward screw and rear pin securing the two receiver portions together.

U.S. Pat. No. 4,139,958, issued to J. P. Foote on Feb. 20, 1979, discloses a caliber conversion system for M-16 and AR 15 rifles. The conversion system includes a bolt/receiver assembly which replaces the bolt carrier of the rifle. The conversion system includes a magazine assembly which can be inserted into a standard M-16 or AR 15 magazine. The conversion bolt includes a groove on its right side for manual retraction of the bolt. Alternatively, the bolts may be manipulated using the rifle's charging handle. The bolt of the conversion unit is structured so that it may be held rearward by the rifle's bolt catch. The bolt may therefore be manually locked back using the rifle's standard bolt catch. However, the bolt will not automatically locked to the rear upon firing the last cartridge within the magazine, as would occur when the rifle's standard caliber ammunition is being used.

U.S. Pat. No. 4,079,555, issued to R. E. Elbe et al. on Mar. 21, 1978, discloses a magazine for a rimfire adapter for a centerfire firearm. The magazine cavity is positions to the rear of the magazine, positioning the base of the shorter cartridge in the same position as the base of the original cartridge.

U.S. Pat. No. 5,556,488, issued to E. Y. Yapp on Oct. 22, 1996, discloses an adapter for a semiautomatic handgun that was originally designed to accept double column magazines. The adapter facilitates the use of single column magazines. And adapter for a similar purpose is disclosed within U.S. Pat. No. 5,555,661, issued to E. Y. Yapp on Sep. 17, 1996.

Smith & Wesson currently manufactures and AR 15 style rifle in .22 lr. caliber, known as the M&P15-22. This rifle utilizes a magazine having an upwardly extending rear projection for activating the bolts catch on this rifle. However, in the absence of an appropriate adapter, this magazine is only useful in the rifle for which it was originally designed. It would be desirable to utilize this magazine with rifles utilizing .22 lr. upper assemblies, as well as rifles utilizing .22 lr. conversion kits.

Regardless of whether training occurs with the original caliber or with a smaller caliber, maintaining the original operation and manipulation of the rifle is critical to maximizing the value of the training. For example, training to perform fast reloads requires the ability to manipulate the rifle in the original manner in order to accomplish the reload. Therefore, automatically holding open the bolt utilizing the bolts catch after the last round in the magazine has been fired is important for accurate training. Furthermore, reloading the rifle utilizing the bolt catch and other original controls is important for training in proper reloading procedure. Reloading is one of many examples where maintaining the original functioning of the weapon while installing a conversion unit is critical.

Accordingly, there is a need for a magazine adapter for use with upper assemblies and caliber conversion units that activates the standard bolt catch on the rifle upon the firing of the last cartridge within the magazine. There is a further need for a magazine adapter that facilitates the use of all original controls on the rifle. There is an additional need for a magazine adapter that is usable with a wide variety of upper assemblies and conversion units. Furthermore, there is a need for a magazine adapter that is securely held in place within the rifle, yet may be easily installed and removed within the rifle.

There is a need for a magazine adapter that does not place unnecessary stresses on the rifle with which it is used. Lastly, there is a need for a magazine adapter that may be utilized with multiple rifle systems, including those that may not necessarily utilize separable upper and lower receiver portions.

SUMMARY

The above needs are met by an improved magazine adapter. One example of the improved adapter accommodates a magazine with a follower having an upward projection extending out of the housing from the follower's rear portion. The adapter has base with a generally horizontal portion having a forward end, a back end, a generally central opening that is dimensioned and configured to receive an upper end of a magazine therein, and a generally vertical slot defined within the back end. The base further has a forward leg depending downward from the forward end, and a back leg depending downward from the back end. A bolt catch actuator is slidably mounted within the slot. The bolt catch actuator moves between a lower position and an upper position. The bolt catch of a firearm may be actuated by upward movement of the bolt catch actuator. The adapter is dimensioned and configured to position the bolt catch actuator above the follower's upwardly projecting arm. When the follower reaches the upper portion of the magazine, the projection of the magazine's follower pushes the bolt catch actuator upward.

Another example of the magazine adapter has a base, having a generally horizontal portion having a forward end, a back end, a generally central opening that is dimensioned and configured to receive an upper end of a magazine therein, and a generally vertical slot defined within the back end. The base further has a forward leg depending downward from the forward end. The base has a back leg depending downward from the back end. A spring-biased plunger is secured within the base. The spring-biased plunger is structured to push against one of the four walls defining the magazine well when the adapter is installed within a firearm. A bolt catch actuator is slidably mounted within the generally vertical slot of the base. The bolt catch moves between a lower position and an upper position. In the upper position, a bolt catch of a firearm may be activated. The adapter is dimensioned and configured to position the bolt catch actuator above a follower projection extending outward from the magazine housing. When the follower reaches the upper portion of the magazine, the projection of the magazine's follower pushes the bolt catch actuator upward.

These and other aspects of the invention will become more apparent through the following description and drawings.

BRIEF DESCRIPTION OF THE DRAWINGS

Like reference characters denote like elements throughout the drawings.

DETAILED DESCRIPTION

Figure 1:
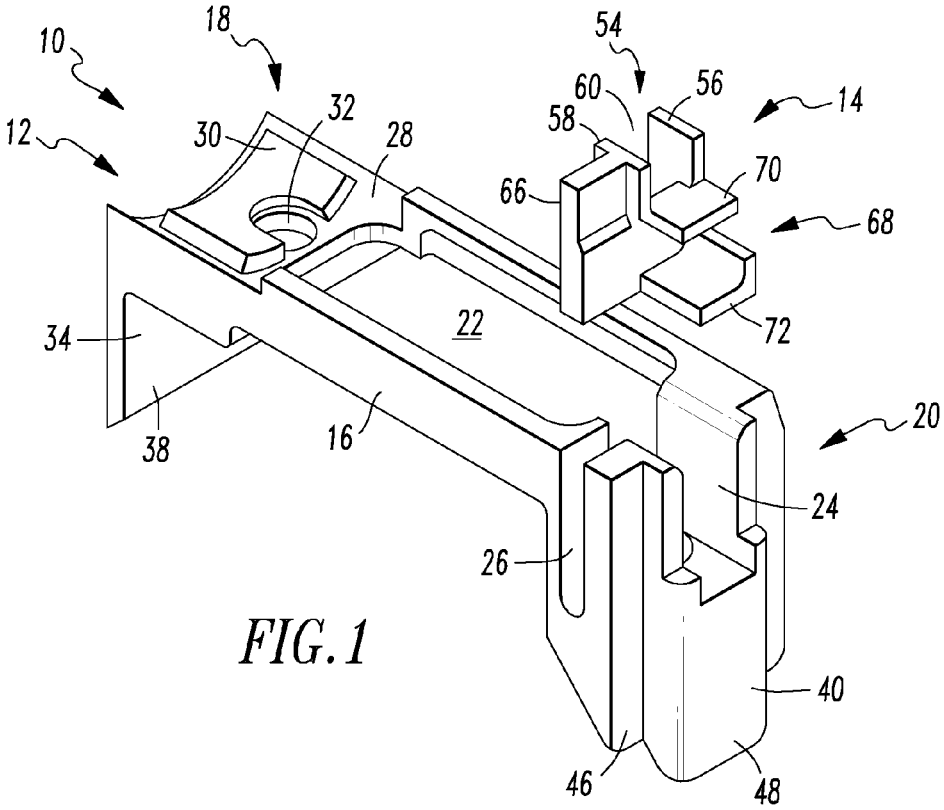
FIG. 1 is a partially exploded perspective view of a magazine adapter.

Referring to the drawings, a magazine adapter 10 is illustrated. The illustrated example of a magazine adapter 10 is particularly suited for permitting the use of magazines designed for a Smith & Wesson M&P15-22 type rifle with .22 lr. conversion units and upper assemblies for M-16 and AR 15 type rifles although it is not limited to such use. As used herein, the terms horizontal, vertical, upper, lower, front, back, etc. are used for convenience to describe components as they are typically located, and are not intended to limit the invention as described or claimed to having a specific orientation. For example, if a rifle in which a magazine adapter 10 is utilized were turned on its side, the orientation of its components would change, but its basic structure and functioning would remain the same.

Figure 2:
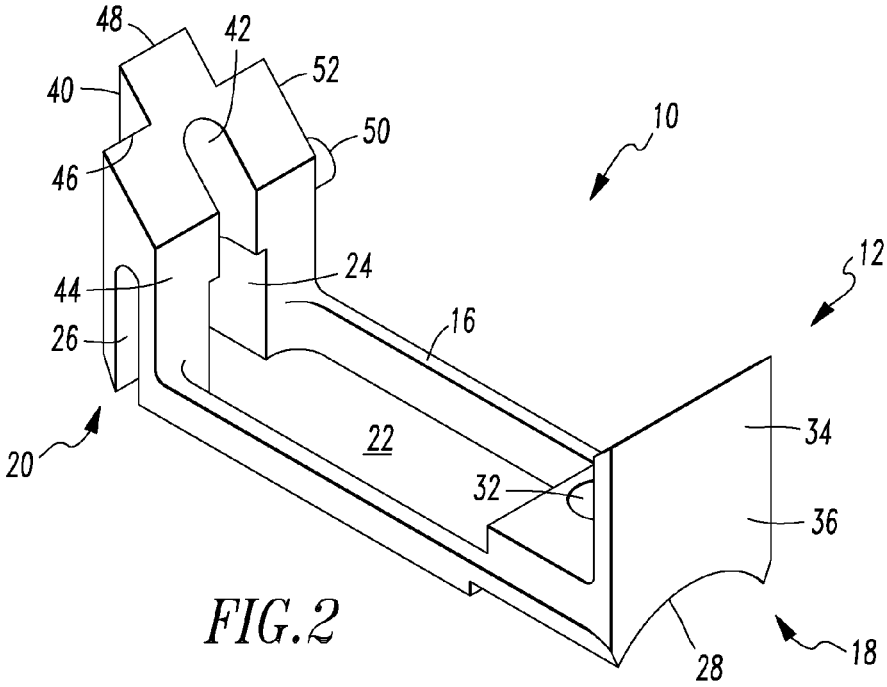
FIG. 2 is a bottom perspective view of the adapter of FIG. 1.

Referring to FIGS. 1-2, the magazine adapter 10 includes a base 12 having a bolt catch actuator 14 slidably mounted therein. The base 12 includes a generally horizontal main portion 16 having a shape that substantially matches the shape of a magazine well for the rifle with which the adapter is intended when viewed from either the top or bottom. The base 16 includes a forward portion 18 and a rear portion 20. The generally horizontal main portion 16 defines an opening 22 that is structured to receive the upper end of a magazine. The rear portion 20 of the base 12 defines a longitudinal channel 24 and a transverse channel 26. The longitudinal channel 24 and transverse channel 26 intersect each other, and in the illustrated example are also in communication with the opening 22. The generally horizontal portion 16 in the illustrated example is concave when viewed from the top, in order to interface with a caliber conversion unit that is structured to replace a bolt carrier of a standard AR 15 rifle. The illustrated example includes a concave forward surface 28 having a cushion 30 affixed thereto. A generally vertical aperture 32 may be defined within the surface 28 to accommodate some presently available caliber conversion units.

The forward portion 18 of the base includes a downwardly depending front leg 34. The illustrated example of a front leg 34 is generally flat on both its exterior surface 36 and interior surface 38. The front leg 34 is structured to abut the interior front wall of a magazine well when the adapter 10 is installed in a rifle, thereby resisting rotational movements of the adapter 10. Similarly, a rear leg 40 depends downward from the rear portion 20 of the base 12. In the illustrated example, the longitudinal channel 24 and transverse channel 26 are partially defined within the rear leg 40. A generally vertical channel 42 is defined within the rear leg 40, and is open along the interior surface 44 of the rear leg 40. The illustrated example of a rear leg 40 defines an exterior surface 46 having a generally vertical, generally centrally located rib 48. The rear exterior surface 46 is structured to substantially abut the rear wall of a magazine well, resisting rotation of the adapter 10 when installed within a rifle.

The base is structured to be removably secured to the interior walls of a magazine well of a firearm. In the illustrated example, a spring biased plunger 50 is secured within the base 12, in the illustrated example projecting generally horizontally outward from the right side 52 of the rear leg 40. The spring biased plunger 50 may project outward from any exterior surface of the base 12 that, when the base 12 is installed within a magazine well, will abut and interior wall of the magazine well. The spring biased plunger 50 is structured to push against and interior wall of the magazine well, thereby retaining the magazine adapter 10 within the magazine well. Because the plunger 50 is spring biased, the strength of the spring biasing the plunger 50 outward from the base 12 may be selected to provide adequate retention of the magazine adapter 10 within the magazine well, without significantly increasing the difficulty of installing and removing the magazine adapter 10 within a magazine well. Other alternative examples of the base 12 may utilize other means of securing the base 12 within a magazine well. For example, a set screw may be provided within the base, so that tightening the set screw causes the set screw to abut an interior wall of a magazine well. As another example, the base 12 may be configured for frictional engagement of the interior of the magazine well, possibly by the addition of resilient material having a high coefficient of friction around the exterior of the base. As yet another example, the magazine well could be modified, possibly by drilling a hole for engaging a spring-biased plunger, a screw, or other fastener for holding the base within the magazine well.

Figure 3:
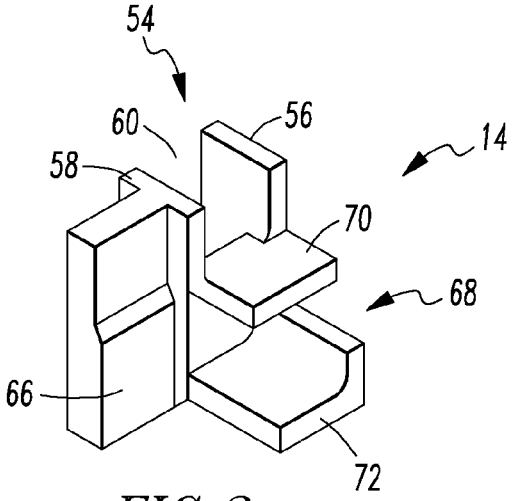
FIG. 3 is a perspective view of a magazine release actuator for the magazine adapter of FIG. 1.
Figure 4:
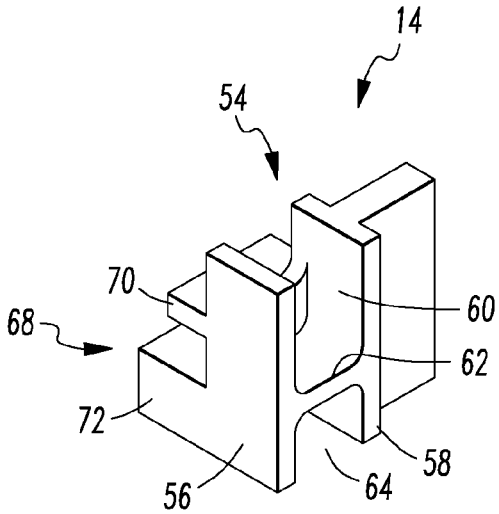
FIG. 4 is a perspective view of the magazine release actuator of FIG. 3.

Referring to FIGS. 1 and 3-4, a bolt catch actuator 14 is illustrated. The bolt catch actuator 14 includes a central section 54 that is structured to fit within the intersection of the longitudinal channel 24 and transverse channel 26, as well as to project downward into the vertical channel 42. The central section 54 includes a pair of walls 56, 58. An upper gap 60 is defined between the upper portions of the walls 56, 58, for receiving the bolt of a caliber conversion unit, or of an upper assembly. A horizontal wall 62 connects the walls 56, 58 below the gap 60. A lower gap 64 is defined between the walls 56, 58 below the horizontal wall 62. A transverse guide flange 66 extends outward from the wall 58, and is structured to fit within the transverse channel 26 of the base 12. A longitudinal guide portion 68 extends rearward from the central section 54, and is structured to fit within the longitudinal channel 24. In the illustrated example, the longitudinal guide portion 68 includes an upper generally horizontal panel 70 and a lower generally horizontal panel 72.

Figure 5:
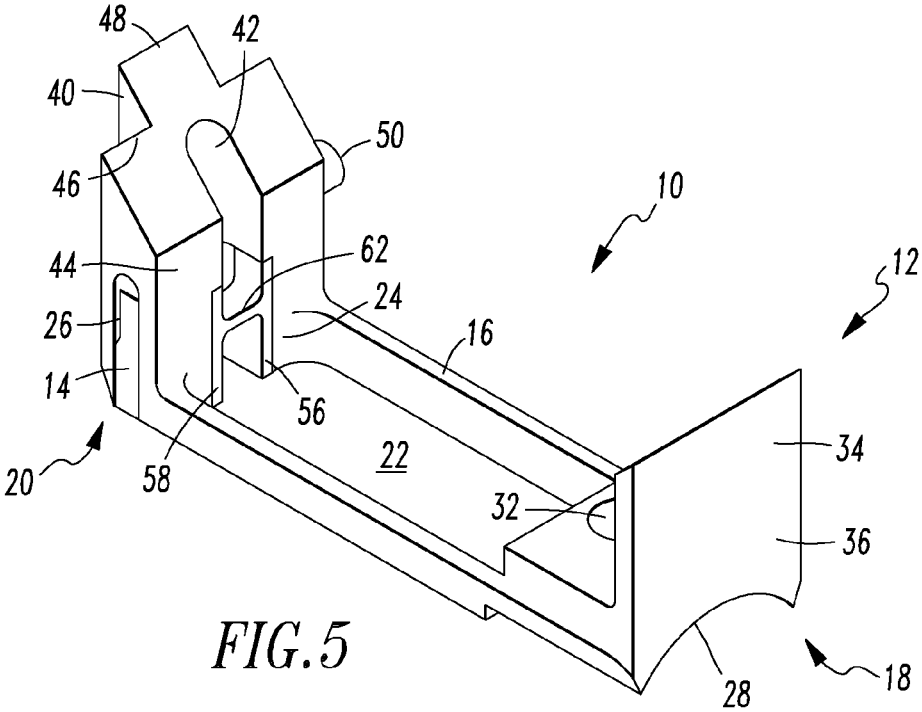
FIG. 5 is a perspective view of the interior rear of the magazine adapter.

Referring to FIGS. 1 and 5, the bolt catch actuator 14 is removably inserted into the rear portion 20 of the base 12, with the transverse guide flange 66 fitting into the transverse channel 26, and the longitudinal guide portion 68 fitting within the longitudinal channel 24.

Figure 6:
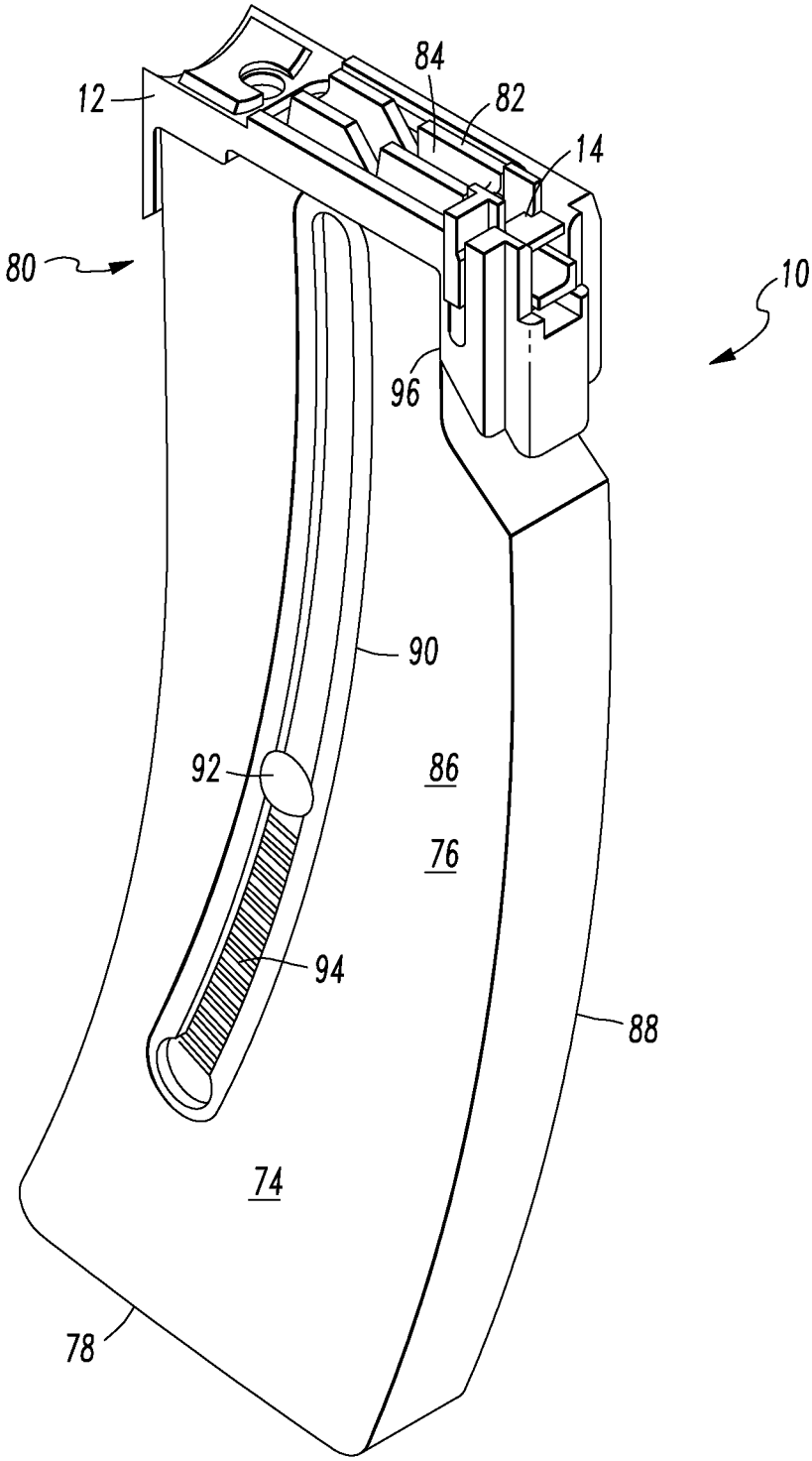
FIG. 6 is a perspective view of the magazine adapter sitting on top of a magazine with the follower depressed and the magazine release actuator in its lower position.
Figure 7:
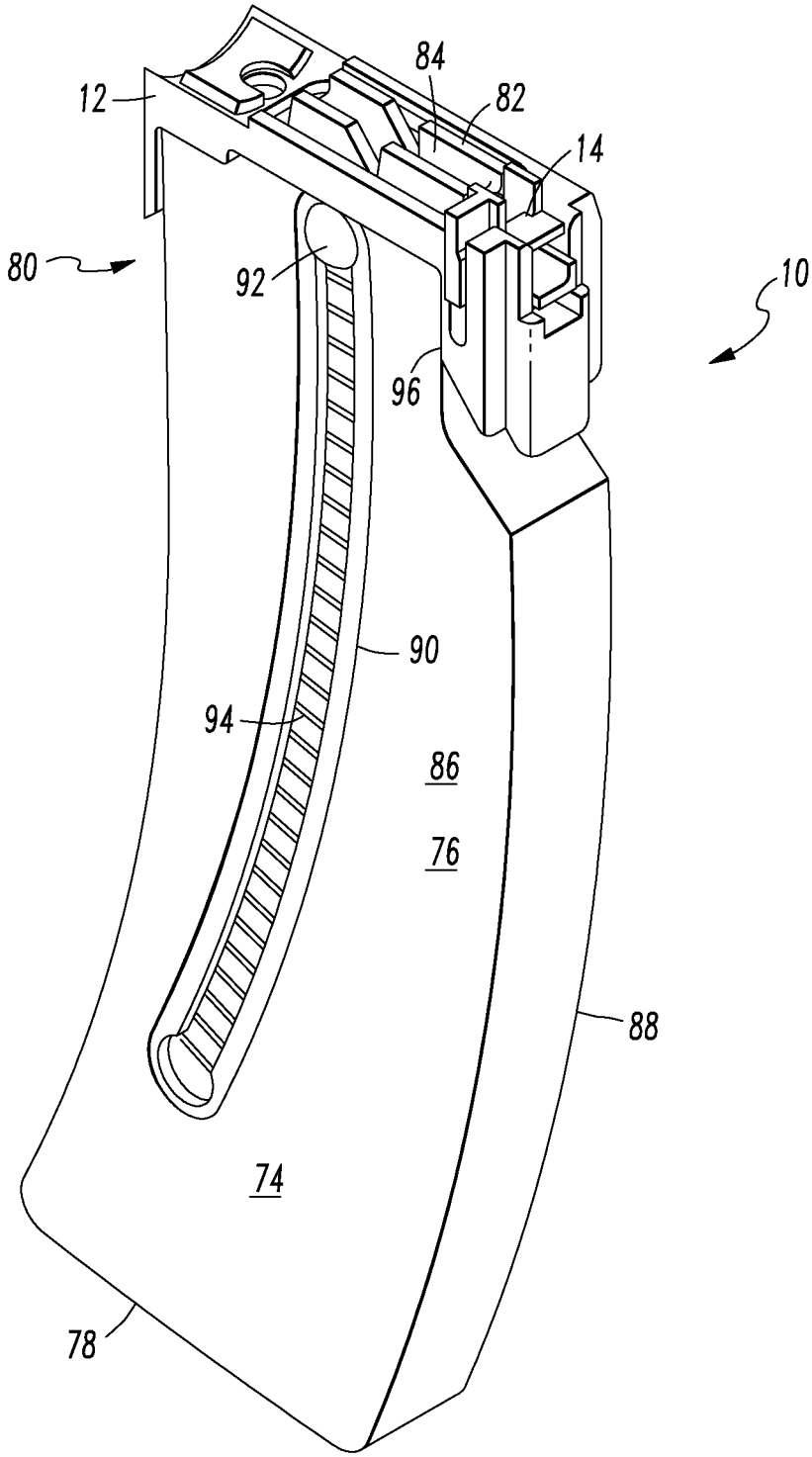
FIG. 7 is a perspective view of the magazine adapter sitting on top of an empty magazine with the follower in its upper position, and the magazine release actuator in its upper position.

Referring to FIGS. 6-7, the magazine adapter 10 is shown in conjunction with a magazine 74. Although the magazine adapter 10 is not intended to be fit onto a magazine 74 outside of the magazine well of a rifle, it is useful to show the interaction of the magazine adapter 10 and the magazine 74 in order to best describe the operation of the magazine adapter 10. The illustrated example of a magazine 74 is a presently available magazine for a Smith & Wesson M&P15-22 rifle, the details of which are known to those skilled in the art. The magazine is shown on the Midway website at http://www.midwayusa.com/product/593377/smith-and-wesson-magazine-s-and-w-m-and-p-15-22-22-long-rifle-25-round-polymer-black, the entire disclosure of which is expressly incorporated herein by reference. The magazine 74 includes a generally tubular housing 76 having a closed lower end 78 and an upper end portion 80. The upper end portion 80 includes a pair of feed lips 82 surrounding an opening 84 through which ammunition may be inserted into or removed from the magazine 74. The sides 86, 88 of the housing each define a slot 90 that generally follows the path of the follower through the magazine 74. The follower includes a thumb tab 92 protruding through each of the slots 90. A spring 94 biases the follower upward within the magazine. The upper portion 80 of the magazine 74 is tapered, and the rear wall 96 of the tapered portion defines an opening through which an upward projection of the follower may protrude when the follower is in the upper portion 80 of the magazine 74. The vertical channel 42 of the base 12 is structured to receive this upward projection, and the horizontal wall 62 of the bolt catch actuator 14 is structured to operatively engage this upward projection.

FIG. 6 shows the follower (as indicated by the thumb tab 92) of the magazine 74 in a lowered position, as would be the case if the magazine 74 contained ammunition. With the follower in this position, the bolt catch actuator 14 is in a lowered position with respect to the base 12. When the follower moves from the lowered position of FIG. 6 to the position of FIG. 7, wherein the follower is in the upper portion 80 of the magazine 74, the upward projection of the follower engages the wall 62 of the bolt catch actuator 14, moving the bolt catch actuator 14 upward with respect to the base 12.

Figure 8:
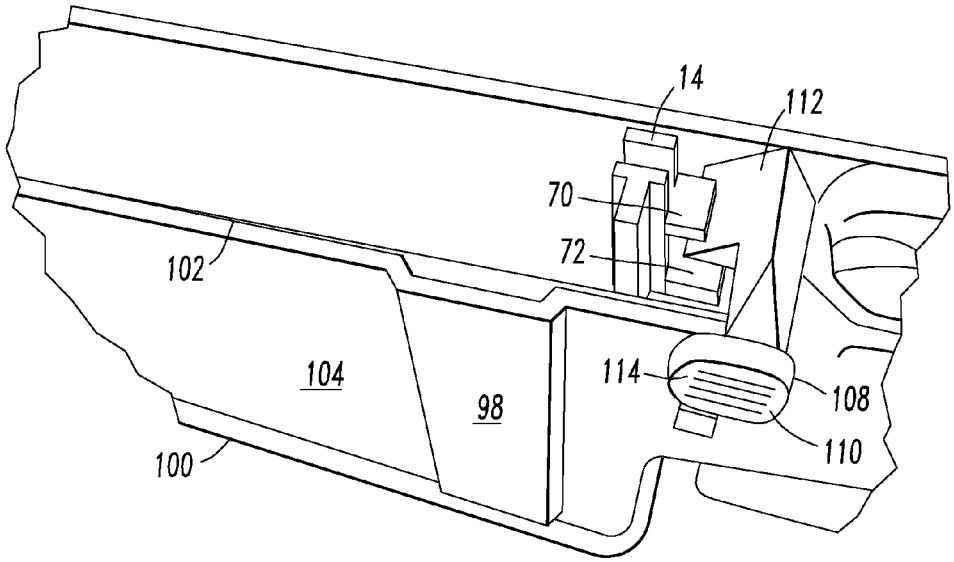
FIG. 8 is a perspective view of the bolt catch actuator of the magazine adapter installed in a rifle, with the upper receiver and lower receiver separated.
Figure 9:
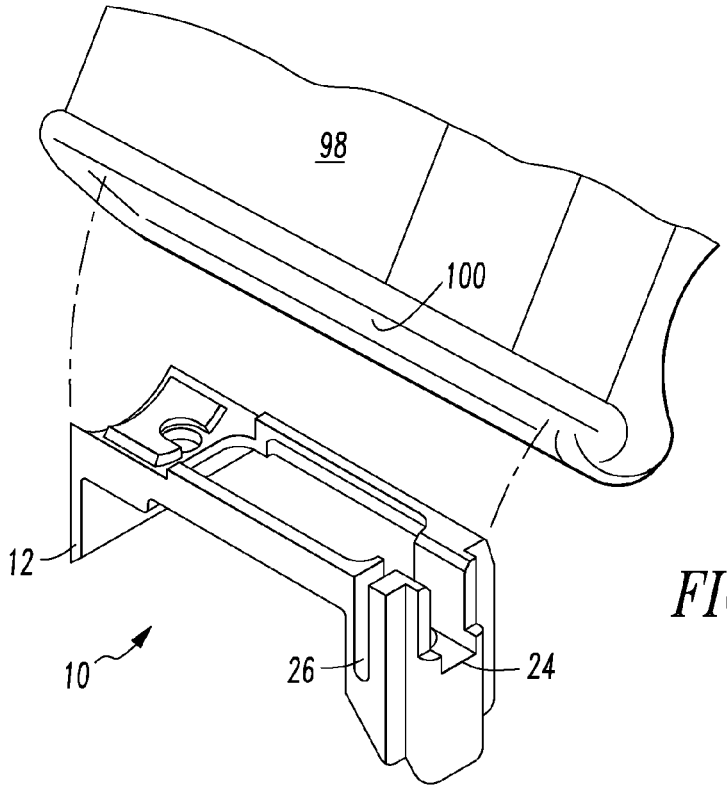
FIG. 9 is a perspective view of the base of the magazine adapter being installed into the magazine well of a rifle.
Figure 10:
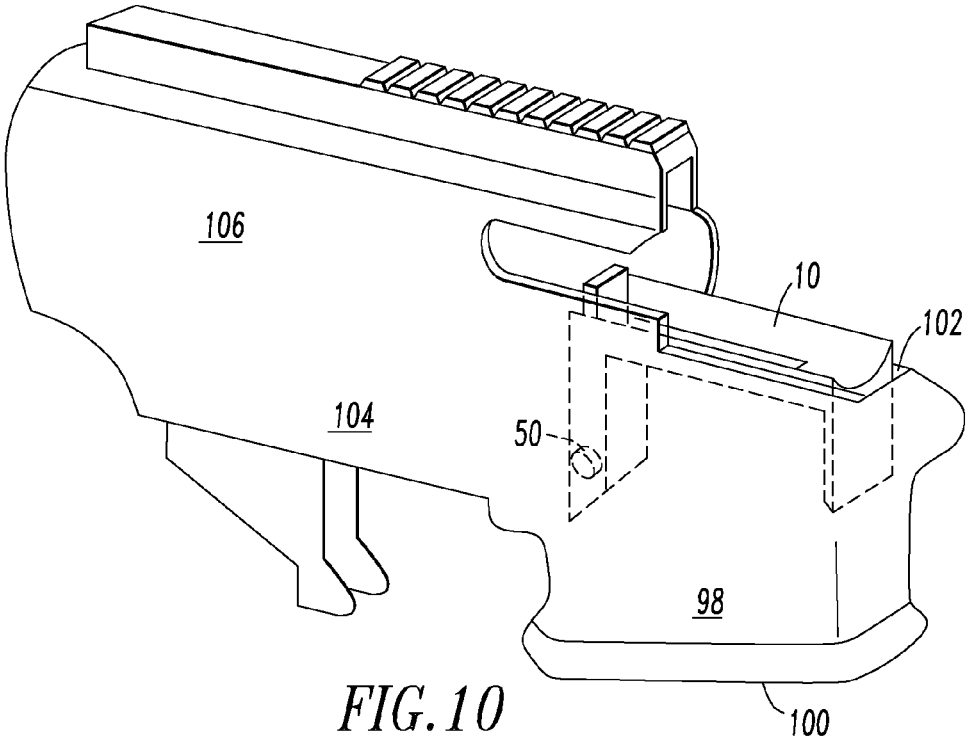
FIG. 10 is a perspective view of the adapter inside a receiver.

Referring to FIGS. 8-10, installation of the magazine adapter 10 into the magazine well 98 of a rifle is illustrated. The lower receiver 104 includes a bolt catch 108. Those skilled in the art of firearms will recognize that the bolt catch 108 includes an external lever 110 and an internal tab 112, and that the entire bolt catch 108 is pivotally secured to the lower receiver 104. As shown in FIG. 8, the bolt catch actuator 14 is first positioned so that the upper horizontal panel 70 is above the tab 112 of the bolt catch 108, and the lower horizontal panel 72 is below the tab 112. As shown in FIG. 9, the base 12 is then inserted into the bottom opening 100 of the magazine well 98. The spring biased plunger 50 is depressed in order to fit the magazine adapter 10 into the magazine well 98. The base 12 is pushed upward through the magazine well 98, depressing the magazine release (not shown, but well understood by those skilled in the art of firearms) as necessary to provide clearance for the upward movement of the base 12. As the base 12 is pushed towards the top of the magazine well 98, the bolt catch actuator 14 is positioned within the longitudinal channel 24 and transverse channel 26 of the base 12, while ensuring that the tab 112 remains between the panels 70, 72. When fully installed, as shown in FIG. 10, the magazine adapter 10 is positioned at the top 102 of the magazine well 98, protruding slightly from the lower receiver portion 104 of the rifle and slightly into the upper receiver portion 104 of the rifle, while still providing clearance for a bolt carrier or caliber conversion unit. The outward pressure of the spring biased plunger 50 creates a sufficient frictional fit to secure the magazine adapter 10 in the proper position within the magazine well 98, without significantly increasing the difficulty of installation or removal of the magazine adapter 10.

With the base 12 in this position, the bolt catch actuator 14 is positioned by the base 12 to operatively engage the bolt catch 108.

Figure 11:
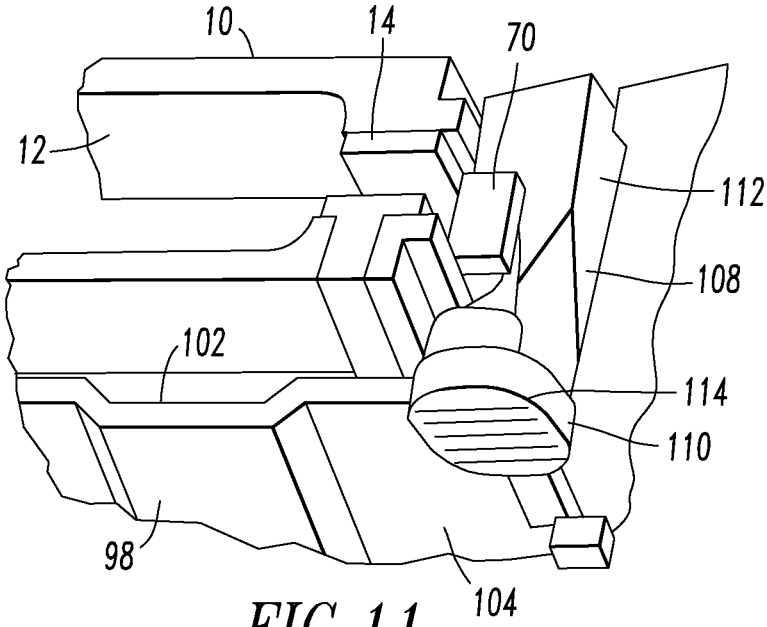
FIG. 11 is a perspective view of the rear portion of the magazine adapter, showing the bolt release actuator in its lowered position.
Figure 12:
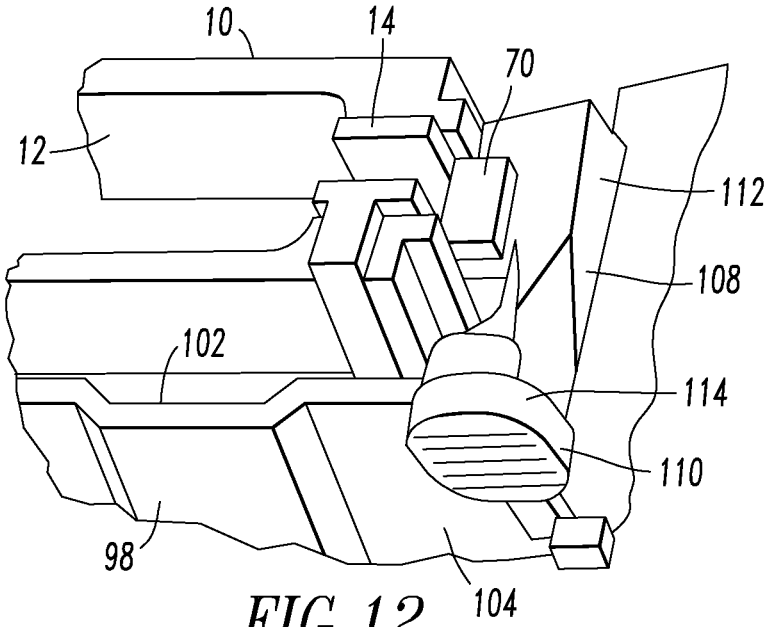
FIG. 12 is a perspective view of the rear portion of the magazine adapter with an empty magazine inserted therein, showing the bolt release actuator in its raised position, engaging the bolt release.

The operation of the magazine adapter 10 with respect to the bolt catch 108 is illustrated in FIGS. 11-12. FIG. 11 illustrates the position of these components when the follower of the magazine 74 is in the position shown in FIG. 6. In this position, the bolt catch actuator 14 is in its lower position, and does not apply any substantial upward pressure to the internal tab 112 of the bolt catch 108. As the follower of the magazine 74 moves from the position of FIG. 6 to the position of FIG. 7, the upward projection at the rear of the follower pushes upward on the bolt catch actuator 14. Upward movement of the bolt catch actuator 14 causes the external tab 112 of the bolt catch 108 to move upward, thereby moving the upper portion 114 of the lever 110 outward with respect to the lower receiver 104. Those skilled in the art of rifles will recognize that the internal tab 112 is also the component of the bolt catch 108 that holds the bolt carrier in its rearward, open position.

The present invention therefore provides a magazine adapter for use with upper assemblies and caliber conversion units that activates the standard bolt catch on the rifle upon the firing of the last cartridge within the magazine. The magazine adapter facilitates the use of all original controls on the rifle. The magazine adapter is usable with a wide variety of upper assemblies and conversion units. The magazine adapter is securely held in place within the rifle, yet may be easily installed and removed within the rifle. The magazine adapter does not place unnecessary stresses on the rifle with which it is used. Lastly, because the magazine adapter is secured within the magazine well rather than between the upper and lower receiver portions, the magazine adapter may be utilized with multiple rifle systems, including those that may not necessarily utilize separable upper and lower receiver portions.

A variety of modifications to the above-described embodiments will be apparent to those skilled in the art from this disclosure. For example, the legs of the base may extend downward from opposing sides of the base rather than opposing ends, as in the illustrated example. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. A magazine adapter configured for use with a firearm, the firearm having a magazine well defined by four walls, each of the four walls of the magazine well defining an interior surface, the firearm further having a reciprocating bolt, the bolt being biased towards a forward position and a bolt catch that is structured to hold the bolt in a rearward position, the adapter comprising:

a base having a forward end, a rear end, and a pair of sides, the base defining an opening for receiving an upper portion of a magazine therein, the base being structured to be removably secured within the four walls of the magazine well, and a bolt catch actuator slidably mounted within said base, the bolt catch being movable between a lower position and an upper position, the bolt catch being structured to be biased towards its upper position when a follower of the magazine that has been inserted into the magazine well reaches an upper position within the magazine, the bolt catch being structured for operative connection to the bolt catch when the base is secured within the magazine well.

2. The magazine adapter according to claim 1, wherein the base includes a pair of downwardly depending legs, the downwardly depending legs being disposed on opposing sides or opposing ends of the base.

3. The magazine adapter according to claim 1, further comprising a base securing device extending outward from the base.

4. The magazine adapter according to claim 3, wherein the base securing device is a spring-biased plunger, the plunger being structured to abut an interior surface of a wall of a magazine well when the adapter is installed in a firearm.

5. The magazine adapter according to claim 1, wherein the base defines a channel that is structured to removably receive the bolt catch actuator therein, the channel being in communication with the opening in the base for receiving an upper portion of the magazine.

6. The magazine adapter according to claim 5, wherein the bolt catch actuator includes a central section, a transverse guide flange extending outward from the central section, and a longitudinal guide portion extending outward from the central portion, substantially perpendicular to the transverse guide flange.

7. The magazine adapter according to claim 6, wherein the central section includes a pair of substantially parallel, substantially vertical walls connected by a horizontal wall that is spaced from the top of the vertical wall, the horizontal wall being structured to abut the projection of the follower when the follower is in an upper position within the magazine.

8. The magazine adapter according to claim 6, wherein the longitudinal guide portion includes a pair of generally horizontal panels, the generally horizontal panels being structured to receive a portion of a bolt catch therebetween.

9. A magazine adapter configured for a magazine, the magazine having a housing, a lower end, an upper end, an upper portion, a feed opening defined within the upper end, a follower slidably secured within the housing, and a spring, the spring being structured to bias the follower towards the feed opening, the housing further defining a follower portion opening disposed in the upper portion of the housing, the follower further having a projection extending therefrom, the projection being structured to protrude from the follower portion opening when the follower is in the upper portion of the housing, the adapter comprising:

a base having a forward end, a rear end, and a pair of sides, the base defining an opening for receiving the upper portion of the magazine therein, the base being structured to be removably secured within a magazine well of a rifle, and a bolt catch actuator slidably mounted within said base, the bolt catch being movable between a lower position and an upper position, the bolt catch being structured to be biased towards its upper position by the projection of a follower of the magazine that has been inserted into the magazine well when the follower reaches an upper position within the magazine, the bolt catch being structured for operative connection to a bolt catch of a rifle when the base is secured within the magazine well.

10. The magazine adapter according to claim 9, wherein the base includes a pair of downwardly depending legs, the downwardly depending legs being disposed on opposing sides or opposing ends of the base.

11. The magazine adapter according to claim 9, further comprising a base securing device extending outward from the base.

12. The magazine adapter according to claim 9, wherein the base securing device is a spring-biased plunger, the plunger being structured to abut an interior surface of a wall of the magazine well when the adapter is installed in the riffle.

13. The magazine adapter according to claim 9, wherein the base defines a channel that is structured to removably receive the bolt catch actuator therein, the channel being in communication with the opening in the base for receiving an upper portion of the magazine.

14. The magazine adapter according to claim 13, wherein the bolt catch actuator includes a central section, a transverse guide flange extending outward from the central section, and a longitudinal guide portion extending outward from the central portion, substantially perpendicular to the transverse guide flange.

15. The magazine adapter according to claim 14, wherein the central section includes a pair of substantially parallel, substantially vertical walls connected by a horizontal wall that is spaced from the top of the vertical wall, the horizontal wall being structured to abut the projection of the follower when the follower is in an upper position within the magazine.

16. The magazine adapter according to claim 14, wherein the longitudinal guide portion includes a pair of generally horizontal panels, the generally horizontal panels being structured to receive a portion of a bolt catch therebetween.

* * * * *